US007681486B2

(12) United States Patent
Ropponen

(10) Patent No.: US 7,681,486 B2
(45) Date of Patent: Mar. 23, 2010

(54) ARRANGEMENT IN CONNECTION WITH AN OSCILLATOR CYLINDER

(75) Inventor: Vesa Ropponen, Punkalaidun (FI)

(73) Assignee: Polarteknik PMC Oy Ab, Huittinen (FI)

( * ) Notice: Subject to any disclaimer, the term of this patent is extended or adjusted under 35 U.S.C. 154(b) by 153 days.

(21) Appl. No.: 11/719,989

(22) PCT Filed: Nov. 23, 2005

(86) PCT No.: PCT/FI2005/000498

§ 371 (c)(1),
(2), (4) Date: May 23, 2007

(87) PCT Pub. No.: WO2006/056642

PCT Pub. Date: Jun. 1, 2006

(65) Prior Publication Data

US 2008/0011156 A1 Jan. 17, 2008

(30) Foreign Application Priority Data

Nov. 23, 2004 (FI) ..... 20041503

(51) Int. Cl.
*F01L 25/02* (2006.01)

(52) U.S. Cl. ..... 91/314; 91/304

(58) Field of Classification Search ..... 91/304, 91/308, 314

See application file for complete search history.

(56) References Cited

U.S. PATENT DOCUMENTS 2,642,299 A 6/1953 Deardorff
2,887,955 A * 5/1959 Owen ..... 91/314
4,111,102 A * 9/1978 Harris ..... 91/480
6,272,968 B1 * 8/2001 Ropponen ..... 91/314
2003/0106418 A1 6/2003 Nelson

FOREIGN PATENT DOCUMENTS

| | | |
|---|---|---|
| DE | 803271 | 4/1951 |
| DE | 1904811 | 9/1969 |
| DE | 3824499 | 1/1990 |
| JP | 7127999 | 5/1995 |

* cited by examiner

*Primary Examiner*—Michael Leslie
(74) *Attorney, Agent, or Firm*—Stites & Harbison PLLC; Douglas E. Jackson

(57) ABSTRACT

An arrangement in combination with an oscillating cylinder (1), whereby the arrangement includes a working valve (10) of cylinder (1) to transmit pressure medium into cylinder (1), impulse valves (5) by means of which, by working valve is controlled, control means (4), as discs, from movable piston rod (18) to cylinder (1) outside, which can be arranged to get in several different linear positions in contact with the control means impulse valves (5) in order to produce a stroke length set for the piston rod of the oscillation cylinder. In the arrangement the impulse valves are placed sideways outside control means (4) and the required impact to be achieved from the control means (to the impulse valves (5) is moved by means of special arms (13) moved from control means (4) as an opening/closing motion of the shut-off part of the impulse valves whereby the structural length of the oscillating cylinder can be achieved essentially shorter in the cylinder back end of control means (4), (5).

5 Claims, 3 Drawing Sheets

ARRANGEMENT IN CONNECTION WITH AN OSCILLATOR CYLINDER

The invention relates to an arrangement in connection with an oscillator cylinder, whereby the arrangement includes a working valve of the cylinder to transmit pressure medium into the cylinder, impulse valves controlling the change of the oscillation direction, by means of which the working valve is controlled, control means, as discs, from the movable piston rod to the outside of cylinder, which can be arranged in several different linear positions to get in contact with the control means of the impulse valves in order to produce a stroke length set for the cylinder piston rod. The impulse valves are placed sideways to the outside of the control means and the required impact to be achieved from the control means to the impulse valves is moved by means of special arms as a motion opening/closing the shut-off part of the impulse valves.

Previously known are oscillating cylinders and valve solutions in combination with them and adjusting means of the oscillating distance, where through the cylinder the piston rod is taken out for the adjusting means of the oscillating distance and the impulse valves beside said piston rod are according to the presentation in FIG. 1. On the piston rod discs adjustable to their location are fitted, due to the locations of which and of joint operation with the impulse valves the oscillation distance can be adjusted. The impulse valves are between the adjustable discs and in this case the piston rod must reach quite far out from the cylinder even by short cylinder length. Accordingly, in known solutions in the cylinder head an equipment shelter must be built at a remarkable distance from the cylinder outward. Control discs adjusting the oscillation length hit directly the peg of the valve spindle, whereby the impulse valves must be between the discs. Usually the discs are remarkably farther from each other than the distance of stroke length set for them. The space requirement of a known control system, which is almost the same as the length of the piston rod in its farthest position from the cylinder (measure a), is obtained adding the impulse valve length+two times the thickness of the guiding disc+two times the stroke length.

In order to remove these disadvantages that increase the structural length of the oscillation cylinder a new arrangement in connection with the oscillation cylinder is developed and the arrangement is characterized in that due to the design of the arms the impulse valves can be placed outside the control means into positions, where they do not increase the structural length of the set piston rod protruding out from the oscillation cylinder, whereby the structural length of the oscillation cylinder can be made essentially shorter in the cylinder end on the side of the control means.

The advantage of the invention is that it is possible to make the structural length of the oscillation cylinder entirety to shorten remarkably, expressly at that part, when the structure is as a harmful protrusion. Especially in combination with paper machines a cylinder installed next to the paper web has to be placed at the frame or supporting structures and in those spots there is hardly any space for a cylinder to be as a protrusion away from the web. When the impulse valves that control the change of oscillation direction are moved off the piston rod side or the side of its extension it has opened surprising possibilities for instance to shorten the distance of control discs to a length shorter than the stroke length set by them. Shortening of the structural length according to the arrangement has no impact on the fitting of valves, service, change or adjustment of stroke length In the following the invention is disclosed with reference to the enclose drawing, where FIG. 1 shows schematically a known oscillation cylinder arrangement.

Figure 1:
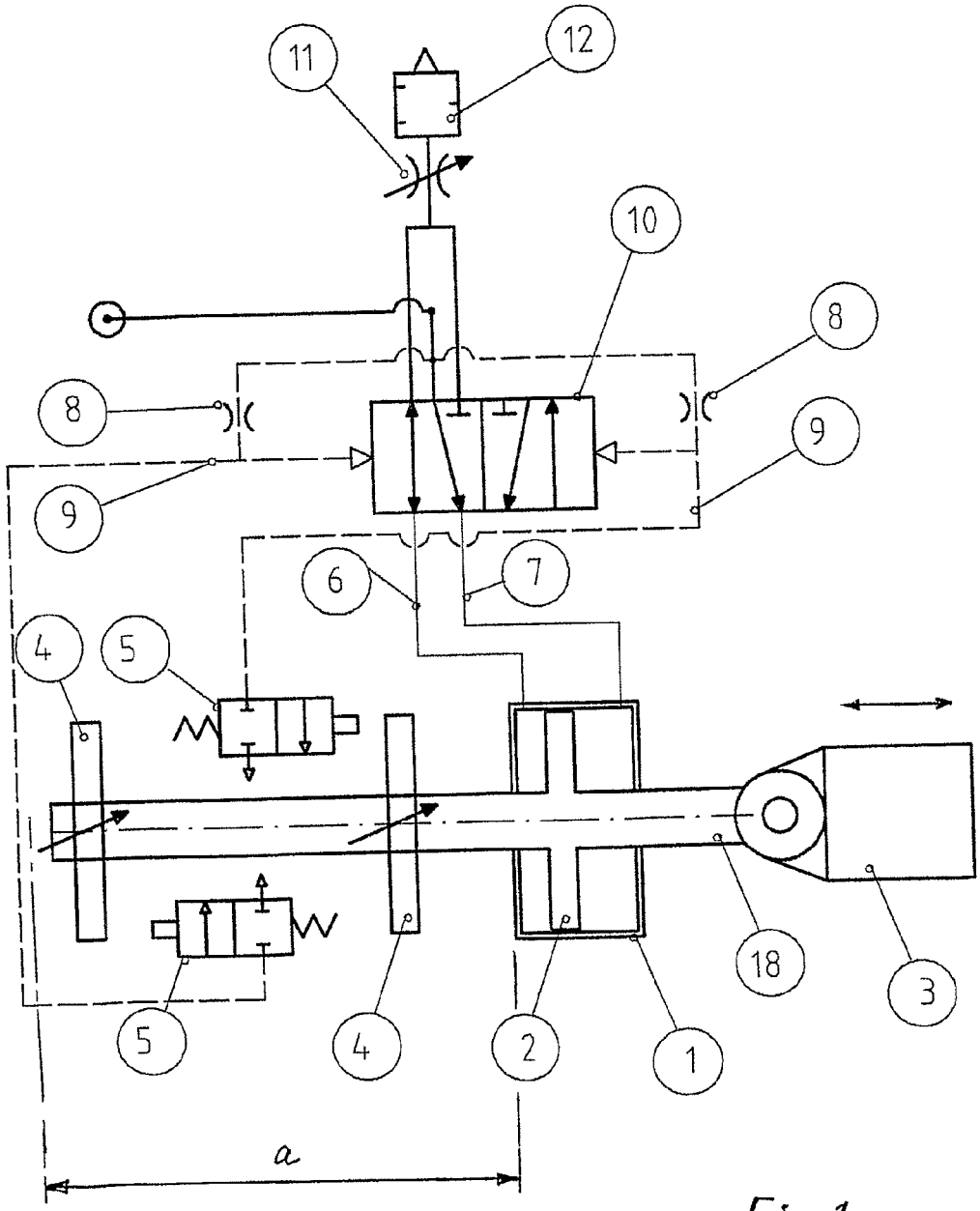
Fig. 1 PRIOR ART

FIG. 1 shows a control diagram of a previously known oscillation cylinder, in which cylinder 1 to piston 2 a moving piston rod 18 is connected, which runs through the cylinders and to the movable actuator or fixing component 3 and further to a device maintaining the adjustment of length of the oscillating motion in other direction. The adjustment of length is done by means of movable discs 4 on piston rod 18. The discs 4 are fixed as such to the rod 18 in a position so that in a wanted piston 2 position discs 4 hit the noses of impulse valves 5 placed between the discs 4. Pushing in the noses of impulse valves 5 opens the impulse valves 5 to let out the control pressures along line 9 from change valve 10 so that change valve 10 in its turn steers the working pressure into cylinder 1 either along line 6 or along line 7. In line 9 there are also chokers 8. The working pressures get out from both sides of piston 2 in turns through control choker 11 and exhaust element 12. By means of control choker 11 the motion speed of piston 2 can be adjusted. The structural length outwards of rod 18 from cylinder 1 is schematically presented by measure a.

Figure 2:
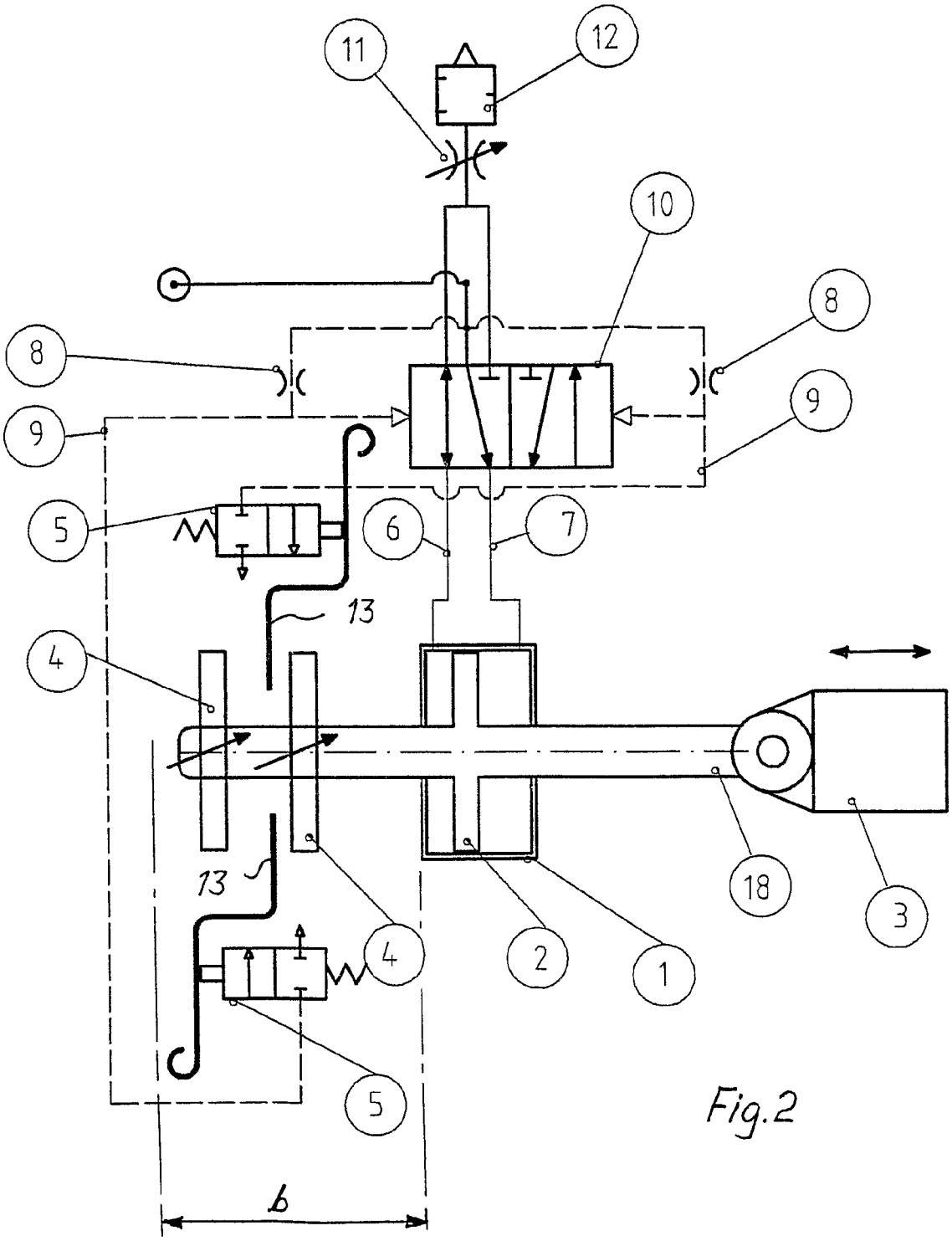
FIG. 2 shows schematically the oscillation cylinder arrangement according to the invention.

FIG. 2 shows a corresponding oscillation cylinder improved according to the arrangement of the invention. Control discs 4 are still on the piston rod 18 but can for adjustment of stroke of a same length as per FIG. 1 be located quite close to each other. Both impulse valves 5 are moved away from between control discs 4. The motion of control discs 4 is by means of arms 13 transmitted to impulse valves 5. Arms 13 are from their end fixed either stiffly to the equipment body or by means of a joint fixed to turn in the equipment body. However, when control disc 4 hits arm 13 and turns the arm towards the peg of impulse valve spindle, arm 13 presses immediately the peg of the valve spindle and impulse valve 5 opens.

When another control disc 4 hits the arm as arrived from the opposite direction the arm bends or turns along with the disc away from the impulse valve. Thanks to these solutions control discs 4 can be notably closer to each other than the distance of the piston length. Further arms 13 can be made to have folds, whereby thanks to the folds impulse valves 5 can be moved more toward the cylinder 1 relative to the position shown in FIG. 1. Arm 13 is stiff, if it is from its end fixed by means of a joint to the equipment body. If arm 13 is fixed stiff to the equipment body, it is then most suitably made of spring material, whereby it bends a little toward the impulse valve 5, when disc 4 moves that way and bends more in other direction if another disc 4 is possibly bending it.

Figure 3:
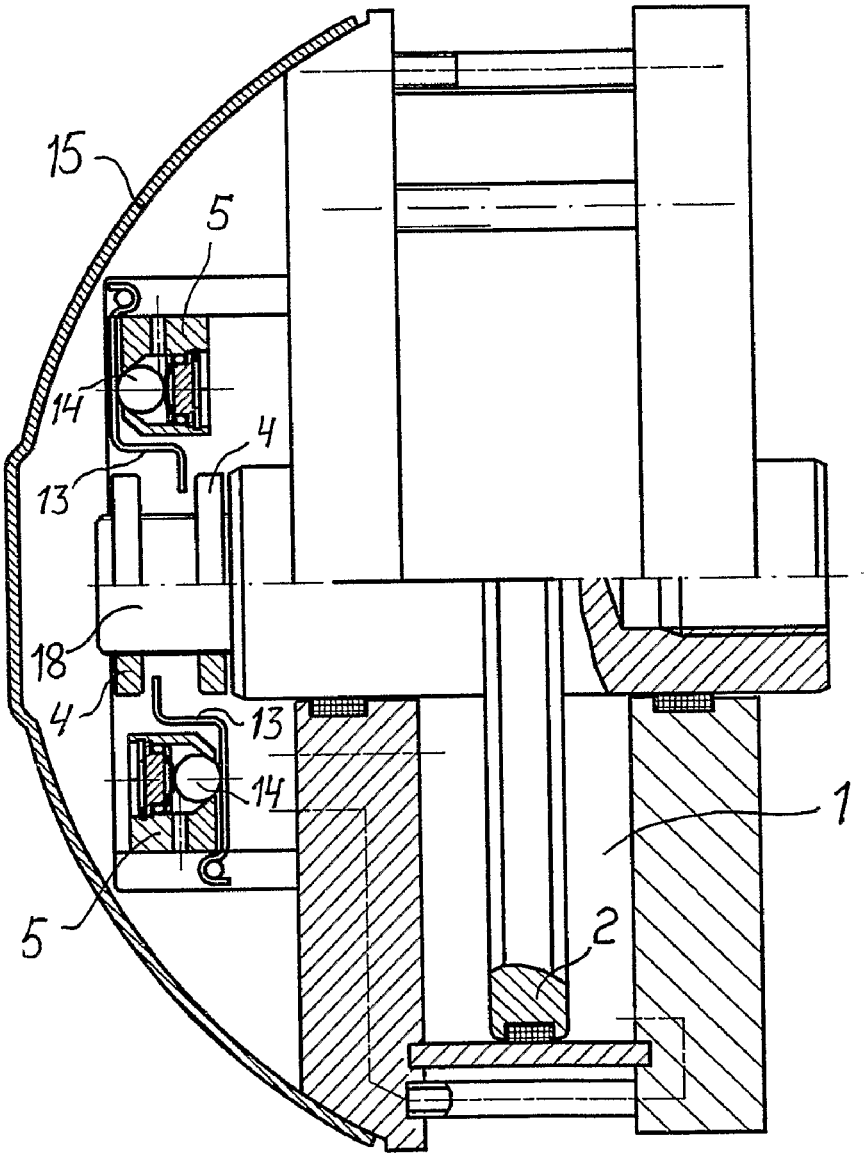
FIG. 3 shows as crosscut of an oscillation cylinder arrangement.

FIG. 3 shows an assembly image of an oscillation cylinder 1 short to its structural length according to the invention. Piston 2 has a short piston rod 18, which protrudes from both sides of the cylinder. Control discs 14 are close to each other, and as impulse valves 5 there are ball valves, where arm 13 pushes ball 14, which immediately opens a channel out off the impulse valve. Arms 13 are fixed to turn at one end by a joint to the equipment body as shown, and thus serve as turning levers. Ball 14 closes the channel straight against the hard counter surface. When ball 14 moves, for instance only about 0.5 mm, a channel already needed past ball 14 opens. Accordingly, for opening impulse valves 5 no motion in the piston rod 18 direction is hardly needed after the arm has reached contact with disc 4. The proper change valve is also placed in a space sheltered with a cover 15. The round spherical cover 15 is easily removed even if there were hardly any free space seen from the cover to the left.

The invention claimed is:

1. A control arrangement for an oscillating cylinder device having a cylinder, a movable piston in the cylinder, and a movable piston rod connected to the piston and having a rod portion always extending outside of the cylinder, said control arrangement comprising:

a working valve of the cylinder device which transmits a pressure medium into different sides of the cylinder to oscillate the piston in the cylinder, respective impulse valves connected to the working valve, each impulse valve having a contact member controlling a shut-off part thereof, each shut-off part effecting a respective change of oscillation direction of the piston by controlling the transmission of the pressure medium from the working valve to the different sides of the cylinder, control elements which extend radially from the rod portion of the movable piston rod outside of the cylinder, the control elements being individually locatable to different linear positions along the rod portion in order to produce a desired stroke length for the piston rod of the oscillation cylinder device, wherein the impulse valves are located radially beyond the control elements extending from the rod portion, and respective arms having one or more folds, the respective arms being adapted to provide a required impact to a respective contact member on the respective impulse valves upon engagement with an associated control element to control an opening/closing of the shut-off part of the respective impulse valves, and whereby the use of the arms to control the impulse valves allows the impulse valves to be placed radially beyond the control elements and in positions where the impulse valves do not increase the structural length of the rod portion always extending from the cylinder, and hence whereby a structural length of the oscillation device is minimized.

2. An arrangement according to claim 1, wherein the arms each have one end fixed by a turning joint to a suitable body portion of the cylinder device and thus the arms act as turning levers.

3. An arrangement according to claim 1, wherein the arms each have one end fixed by a stiff joint to a suitable body portion of the cylinder device and each arm is flexible so as to move by bending when engaged by an associated one of the control elements.

4. An arrangement according to claim 1, wherein the control elements are discs adapted to be placed closer to each other than the desired stroke length of the cylinder.

5. An arrangement according to claim 1, wherein the shut-off part of each impulse valve is a ball that lets a pressure medium out of the respective impulse valve.

* * * * *